United States Patent [19]

Nakajima et al.

[11] 4,346,982

[45] Aug. 31, 1982

[54] ELECTROPHOTOGRAPHIC RECORDING DEVICE

[75] Inventors: Junzo Nakajima, Kawasaki; Masayuki Hida, Yokohama; Masakatsu Horie, Atsugi, all of Japan

[73] Assignee: Fujitsu Limited, Kawasaki, Japan

[21] Appl. No.: 139,402

[22] Filed: Apr. 11, 1980

[30] Foreign Application Priority Data

Apr. 20, 1979 [JP] Japan ..... 54-48675

[51] Int. Cl.[3] ..... G03G 15/048; G03G 15/30

[52] U.S. Cl. ..... 355/3 R; 355/7; 355/14 E; 430/54

[58] Field of Search ..... 430/54; 355/3 R, 7, 355/11, 14 E

[56] References Cited

U.S. PATENT DOCUMENTS

| | | | |
|---|---|---|---|
| 3,816,115 | 6/1974 | Gundlach et al. | 430/54 |
| 3,871,878 | 3/1975 | Mino et al. | 430/54 |
| 3,926,824 | 12/1975 | Lipani | 430/54 X |
| 4,050,804 | 9/1977 | Silverberg | 355/3 R X |
| 4,078,929 | 3/1978 | Gundlach | 430/42 |
| 4,167,324 | 9/1979 | Wu | 355/7 X |

FOREIGN PATENT DOCUMENTS

| | | | |
|---|---|---|---|
| 7756 | 2/1980 | European Pat. Off. | 355/7 |
| 55-28002 | 2/1980 | Japan . | |

OTHER PUBLICATIONS

"Positive Dev. Overlay System", Xerox Disclosure Journal, vol. 1, #3, Mar. 1976 by Robert A. Ludlow, p. 17.

"Electrophotographic Process in a High Speed Printer", IBM J. Develop., vol. 22, #1, Jan. 1978, pp. 34–39 by U. Vahtra et al.

"Principles of a High-Speed Non-Impact Printer", Journal of Photographic Science, vol. 25, 1977, pp. 186–188 by P. Graf.

*Primary Examiner*—J. V. Truhe
*Assistant Examiner*—Richard M. Moose
*Attorney, Agent, or Firm*—Staas & Halsey

[57] ABSTRACT

An electrophotographic recording device suitable for a Form Overlay System, by which a latent image is formed on a surface of a light-sensitive recording medium, consisting of a first area which is maintained at an original potential, a second area which is maintained at a partially reduced potential and a third area which is maintained at a potential of zero.

6 Claims, 16 Drawing Figures

ELECTROPHOTOGRAPHIC RECORDING DEVICE

BACKGROUND OF THE INVENTION

The present invention relates to a device for electrophotographic reproduction. The device of the present invention can be used for a printing device with an optical fiber tube (OFT) or a laser.

With regard to printers for electronic computers, a system called a Forms Overlay System has been used in which both a picture portion and a character portion are reproduced by means of electrophotographic reproduction. Such a Forms Overlay System can be used for printing documents or bills consisting of a picture portion comprising frames, invariable indications and the like, and a character portion comprising specific characters selected for each of the documents or bills. In such a Forms Overlay System, it is preferable to reproduce a picture directly from a positive original document, because it is time-consuming and expensive if the reproduction is effected by using a negative picture after the process of obtaining said negative picture from the positive document.

A prior art process of electrophotographic reproduction used for the Forms Overlay System is illustrated in FIGS. 1A through 1D. First, a light sensitive recording medium 6 is charged with electrostatic charges q to a potential $V_O$ of, for example, 700 volts (FIG. 1A). Then, as shown in FIG. 1B, a picture portion 7 is formed by applying an exposing light reflected from the surface of a positive original document. The portion 61 of the light sensitive medium 6 other than the picture portion 7 is exposed by the light so that about one half of the charges q are removed to attain the potential of $V_l$, which is about one half of $V_O$ (FIG. 1B). Then, as shown in FIG. 1C, a character portion 9 is formed by applying an exposing light emitted from an OFT. The charges of the character portion 9 are maintained so that the potential is maintained at $V_l$. About one half of the charges of the picture portion are removed to attain the potential $V_l$. The charges in the portion 61 of the light sensitive medium 6 other than the picture portion 7 and the character portion 9 are removed to attain a zero potential (FIG. 1C). Then, as shown in FIG. 1D, negatively charged toner t is applied to the latent images of the picture portion 7 and the character portion 9. Thus, the development of the picture and the character is performed (FIG. 1D). The potential distribution on the light sensitive medium 6 along a line II—II in FIGS. 1A, 1B and 1C is illustrated in FIGS. 2A, 2B and 2C, respectively in which the abscissa represents a longitudinal distance along the line II—II and the ordinate represents a potential. The prior art process of photographic electrostatic reproduction illustrated in FIG. 1 was proposed by the inventors of the present invention in the Japanese Patent Application No. 53-99949. Also, the general prior art processes of the Forms Overlay System which need negative picture originals were disclosed in, for example, the paper entitled "Electrophotographic Process in a High Speed Printer" in IBM J. RES. DEVELOP. Vol. 22, No. 1, January 1978, pages 34 through 39, and the paper entitled "Principles of a High-speed Non-impact Printer", in the Journal of Photographic Science, Vol. 25, 1977, pages 186 through 188.

In the prior art process illustrated in FIGS. 1A through 1D, the exposure by the OFT for forming the character portion must be effected by means of a "positive exposure" of the OFT, under the condition where ordinary materials are used for the toner for image development. The "positive exposure" of the OFT is an exposure in which an exposing light is projected only to the portions 61 and 7, and not to the character portion 9, on the light sensitive medium. This is because, under the above mentioned condition, it is impossible to develop both the picture portion 7 and the character portion 9 by means of a "negative exposure" of the OFT. The "negative exposure" of the OFT is an exposure in which light is not projected to the portions 61 and 7, and only to the character portion 9.

However, in the prior art process illustrated in FIGS. 1A through 1D, the positive exposure of the OFT incurs a disadvantage in that a larger portion outside the minor character portion of the fluorescent surface of the OFT receives the irradiation of the emitted electrons and causes light emission in said larger portion of the fluorescent surface of the OFT, so that the fluorescent surface of the OFT is apt to be deteriorated. When a semiconductor laser is used in place of the OFT, the light emission of the semiconductor laser of the larger portion other than a minor character portion also causes the output of the semiconductor laser to deteriorate, so that the life of the semiconductor laser is reduced.

The present invention has been proposed in order to eliminate the above explained disadvantages in the prior art process of photographic electrostatic reproduction.

SUMMARY OF THE INVENTION

It is the principal object of the present invention to provide an improved electrophotographic recording device applicable to a Forms Overlay System in which the deterioration of a fluorescent surface of an optical fiber tube or a semiconductor laser used in said electrophotographic recording device is prevented.

In accordance with the present invention, there is provided an electrophotographic recording device having means for uniformly charging the surface of a light-sensitive recording medium, means for forming latent images on said light-sensitive recording medium and means for developing said latent images into visual images, said electrophotographic recording device being characterized in that said means for forming latent images on said light-sensitive recording medium comprises a plurality of exposing means for exposing a positive optical image and a negative optical image in such a manner that the light receiving region of said negative optical image overlaps the light receiving region of said positive optical image, whereby a latent image is formed on the surface of said light-sensitive recording medium consisting of a first area which does not receive any light of said negative or positive image and holds an original potential, a second area which receives the light of only said positive image and holds a reduced potential from that of said original potential and a third area which receives the light of both of said negative image and said positive image and holds a further reduced potential than said reduced potential of said second area.

DESCRIPTION OF THE PREFERRED EMBODIMENTS

Figure 1A:
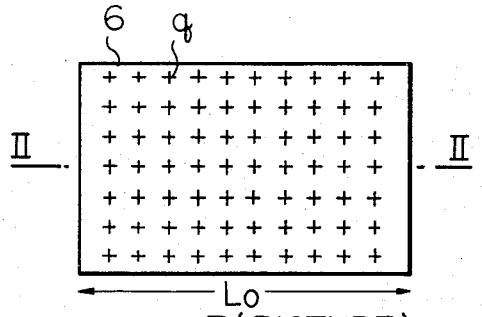
Fig. 1A (PRIOR ART)
FIGS. 1A through 1D illustrate a prior art electrophotographic recording process.
Figure 1B:
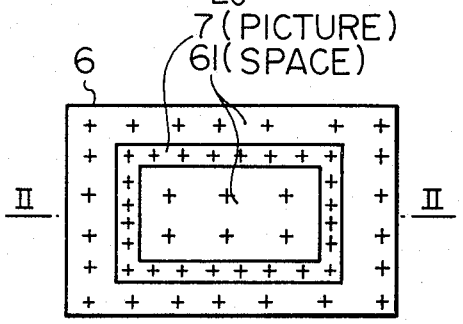
Fig. 1B (PRIOR ART)
Figure 1C:
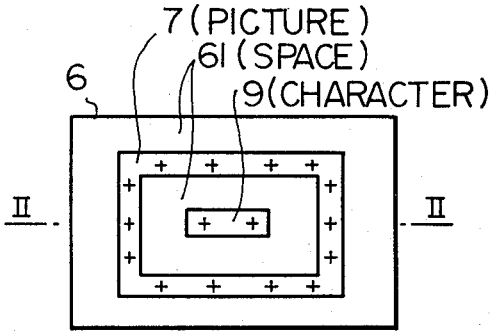
Fig. 1C (PRIOR ART)
Figure 1D:
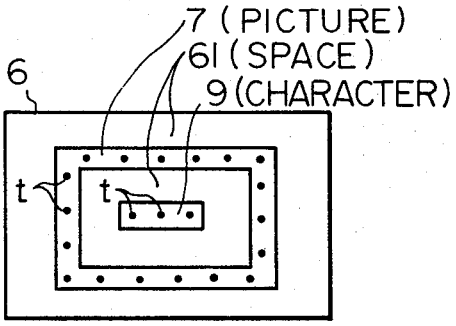
Fig. 1D (PRIOR ART)
Figure 2A:
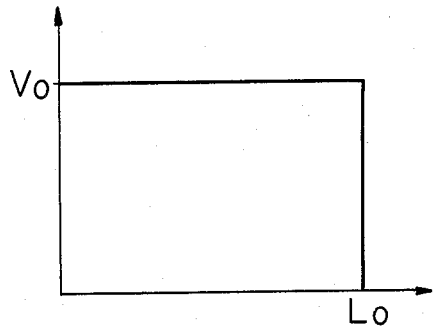
Fig. 2A (PRIOR ART)
FIGS. 2A through 2C illustrate the distribution of electrostatic voltage along a line II—II traversing a recording medium used in the process of FIGS. 1A through 1D.
Figure 2B:
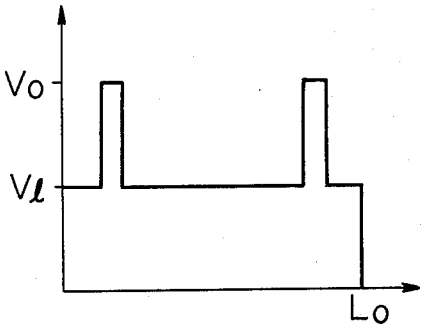
Fig. 2B (PRIOR ART)
Figure 2C:
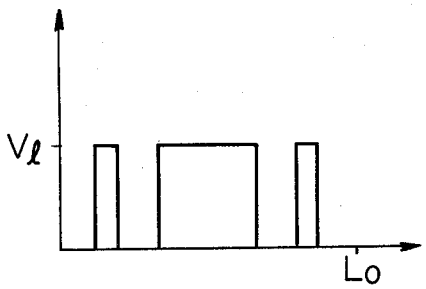
Fig. 2C (PRIOR ART)
Figure 3:
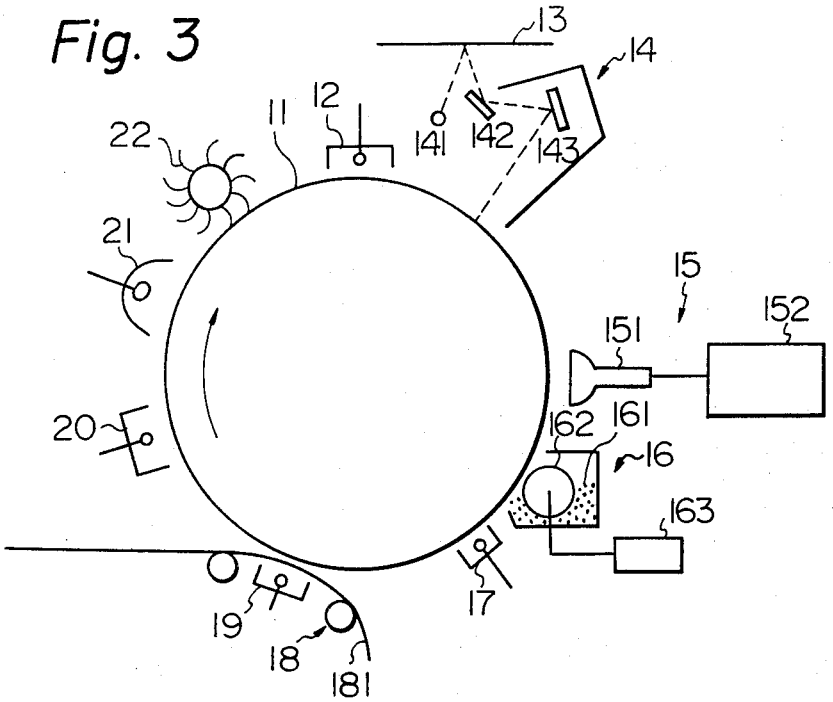
FIG. 3 illustrates an electrophotographic recording device in accordance with an embodiment of the present invention.

An electrophotographic device illustrated in FIG. 3, as an embodiment of the present invention, comprises: a recording drum 11 having a surface of photoconductive material, such as selenium; a first corotron 12 for emitting a corona discharge on the recording drum 11; an optical system 14, for forming an optical image of an original picture 13 on the recording drum 11, comprising a light source 141, and mirrors 142 and 143; an optical fiber tube system 15, for forming an optical image of characters on the recording drum 11, comprising an optical fiber tube 151 and a character signal generating device 152; a developing device 16, for applying toners on electrostatic latent images on the recording drum 11, comprising toners 161, a magnetic roller 162 and a voltage source 163; a second corotron 17 for emitting a corona discharge for compulsorily charging of the toners attached on the surface of the recording drum; a recording paper transport system 18 for transporting a recording paper 181 through the picture transfer region; a third corotron 19 for emitting a corona discharge on the back surface of the recording paper 181; a fourth corotron 20 for eliminating charges on the recording drum 11; a lamp 21 for eliminating charges on the recording drum 11, and; a cleaner 22 for removing toners remaining on the recording drum 11.

Figure 5A:
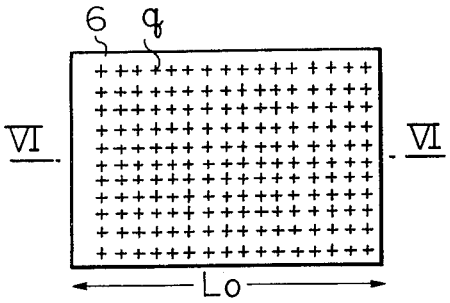
FIGS. 5A through 5D illustrate the electrophotographic recording process achieved in the device of FIG. 3.
Figure 5B:
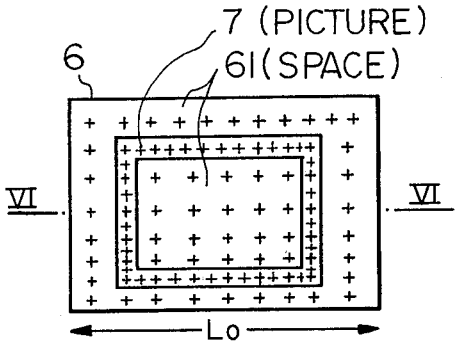
Figure 5C:
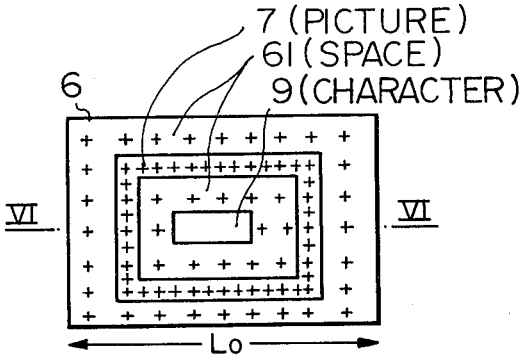

The electrophotographic recording process for recording both a picture portion and a character portion by the device of FIG. 3 is illustrated in FIGS. 5A through 5D. Due to the charging of the recording drum 11 by the first corotron 12, the light-sensitive recording medium 6 is uniformly charged with a positive charge to attain a potential $V_O$ (FIG. 5A, and FIG. 6A). Then, a positive image 7 of the original picture 13 is formed on the light-sensitive recording medium 6 by exposing light emitted from the optical system 14 onto the portion 61. Due to the selection of the intensity of the light source 141, about one half of the charges in the portion 61 outside of the picture portion 7 of the light-sensitive recording medium 6 is eliminated, so that the potential of the portion 61 is reduced to $V_l$, which is about one half of $V_O$ (FIG. 5B and FIG. 6B). Then, a negative image 9 of a character corresponding to a character signal produced in the character signal generating device 152 is formed on the portion 61 of the light-sensitive recording medium 6 by exposing light emitted from the optical fiber tube 151. That is, as shown in FIG. 5C, the light receiving region of the negative optical image 9 overlaps the light receiving region 61 of the positive optical image. Thus, the charges in the character portion corresponding to the negative image 9 are eliminated so that the potential of said character portion is reduced to about zero. Consequently, as illustrated in FIGS. 5C and 6C, there is formed on the light-sensitive recording medium 6, a first area corresponding to the positive image 7 which does not receive any light of the negative or positive image and having the original potential $V_O$, a second area corresponding to the space 61 which receives the light of only the positive image and having a reduced potential $V_l$, for example, $V_l = \frac{1}{2}V_O$, and a third area corresponding to the negative image 9 which receives the light of both the negative and the positive images and having a further reduced potential, for example, zero potential.

Figure 4:
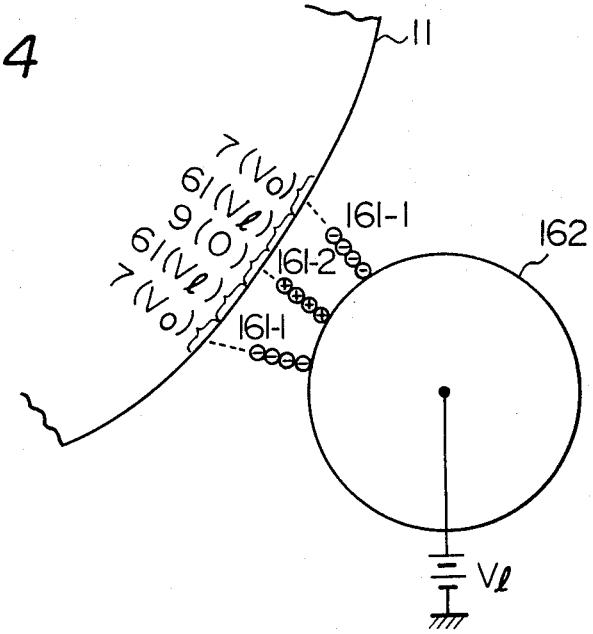
FIG. 4 illustrates a toner attracting process effected in the device of FIG. 3.
Figure 5D:
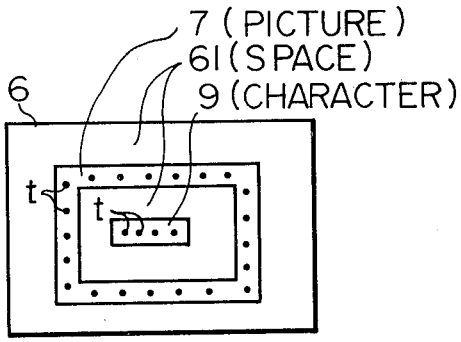
Figure 6A:
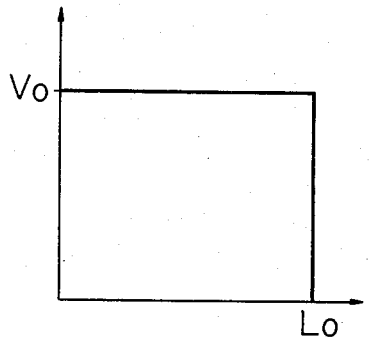
FIGS. 6A through 6C illustrate the distribution of electrostatic voltage along a line VI—VI traversing a recording medium used in the process of FIGS. 5A through 5D.
Figure 6B:
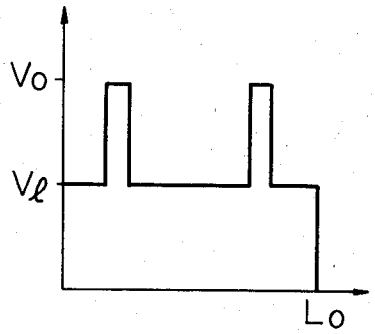
Figure 6C:
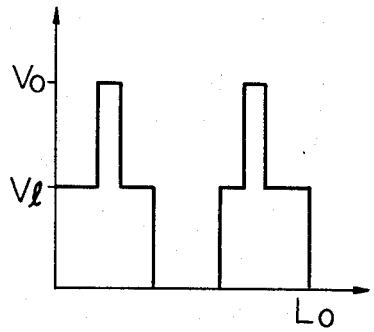

Then, as shown in FIGS. 3, 4, and 5D, single component toners t (161) are applied to the recording medium 6 on which the above described latent images of the picture portion 7 and the character portion 9 are formed. In the developing device 16, the magnetic roller 162 is maintained at an electrical potential of $V_l$ by means of a voltage source 163. Slightly conductive toner 161-1 is caused to be negatively charged due to a charge injection effect based on an electrostatic induction corresponding to the picture portion 7 having the high positive potential $V_O$. Slightly conductive toner 161-2 is caused to be positively charged due to a charge injection effect based on an electrostatic induction corresponding to the character portion 9 having the zero potential. No toner is caused to be positively or negatively charged corresponding to the space portion 61 because portion 61 has the same potential as the magnetic roller 162 (FIG. 4). As a result, the negatively charged toner 161-1 attaches to the picture portion 7, the positively charged toner 161-2 attaches to the character portion 9, and no toner attaches to the space portion 61 (FIG. 5D).

After the toners attached to the picture and the character portions are compulsorily charged with negative charges by means of the second corotron 17, the toners thus negatively charged are transferred to the surface of a recording paper 181 by means of the third corotron 19, which emits positive charges on the back surface of the recording paper 181. Accordingly, recording on the recording paper 181 of the image of the original picture 13 and the image of the character produced in the character signal generating device 152 is performed.

The recording paper 181 carrying the attached toners is heated after the above described transfer of the toner so that the toners forming the recorded pictures and characters are fixed to the recording paper. The remaining charges on the recording drum 11 are eliminated by means of the fourth corotron 20 and the lamp 21. The remaining toners on the recording drum 11 are removed by means of the cleaner 22. After the removal of the toner by the cleaner 22, the recording drum is again charged by means of the first corotron 12 to commence the next recording process.

It is possible to use either a light sensitive drum or zinc oxide papers for the recording medium. Although in the above described embodiment the polarity of the charges applied on the light-sensitive recording medium 6 is selected to be positive, it is possible to select the polarity of said charges to be negative.

The intensity of the exposing light emitted from the optical system 14 and the ratio of the voltage $V_l$ to the voltage $V_O$ can be selected to be the most suitable values in accordance with the operational conditions. Although in the above described embodiment the exposure of characters by the optical fiber tube is effected after the exposure of a picture by the optical system, it is possible to effect the exposure of characters by the optical fiber tube prior to the exposure of a picture by the optical system.

Furthermore, although single component toner of a single color is used in the above described embodiment, it is possible to use two component toners of different colors, so that the picture portion is recorded with the toners of a first color, while the character portion is recorded with the toners of the second color. When a development by such two component toners is effected, one component of the toners is charged with one polarity and the other component of the toners is charged with the opposite polarity.

It is also possible to expose a picture by the optical system and develop this exposed picture by applying toners of a first color, and then expose characters by the optical fiber tube and develop these exposed characters by applying toners of a second color.

We claim:

1. An electrophotographic recording device comprising: a light-sensitive recording medium, means for uniformly pre-charging the surface of said light-sensitive recording medium, means for forming a latent image of a picture on the charged lightsensitive recording medium by exposure of a positive optical image of the picture, means for forming latent images of characters on the charged light-sensitive recording medium by exposure of negative optical images of the characters, and means for development of the latent images formed on the light-sensitive recording medium including a magnetic roller having a potential selected as a predetermined value between the potential of the precharged light-sensitive recording medium and zero potential and single component toner for development of said latent images of both the picture and the characters.

2. An electrophotographic recording device as defined in claim 1, wherein the formation of the latent image on the light-sensitive recording medium for the positive optical image is effected prior to the formation of the latent image on the light-sensitive recording medium for the negative optical image.

3. An electrophotographic recording device as defined in claim 1, wherein the formation of the latent image on the light-sensitive recording medium for the negative optical image is effected prior to the formation of the latent image on the light-sensitive recording medium of the positive optical image.

4. The device of claim 1 wherein said character forming means comprises an optical fiber tube system.

5. The device of claim 1 wherein said character forming means comprises a semiconductor laser system.

6. The device of claim 1, 4 or 5, wherein said picture and character forming means form latent images on said light-sensitive recording medium consists of a first area which does not receive any light of said negative or positive optical image and holds an original potential, a second area which receives the light of only said positive optical image and holds a reduced potential from that of said original potential and a third area which receives the light of both said negative optical image and said positive optical image and holds a further reduced potential than said reduced potential of said second area.

* * * * *

UNITED STATES PATENT AND TRADEMARK OFFICE

CERTIFICATE OF CORRECTION

PATENT NO. : 4,346,982

DATED : Aug. 31, 1982

INVENTOR(S) : Nakajima et al.

It is certified that error appears in the above-identified patent and that said Letters Patent is hereby corrected as shown below:

Title page, 2nd column, "Other Publications", line 1, "Dev." should be --Development Xerographic--.
Column 3, line 48, after "charge" insert --q--.
Column 5, line 24, "lightsensitive" should be --light-sensitive--.

Signed and Sealed this

First Day of March 1983

[SEAL]

*Attest:*

GERALD J. MOSSINGHOFF

*Attesting Officer*

*Commissioner of Patents and Trademarks*